US009688074B1

(12) United States Patent
Hall, Jr. et al.

(10) Patent No.: US 9,688,074 B1
(45) Date of Patent: Jun. 27, 2017

(54) FLUIDIC DISPENSING DEVICE HAVING MULTIPLE STIR BARS

(71) Applicant: FUNAI ELECTRIC CO., LTD., Osaka (JP)

(72) Inventors: William D. Hall, Jr., Mt. Sterling, KY (US); Steven R. Komplin, Lexington, KY (US)

(73) Assignee: FUNAI ELECTRIC CO., LTD. (JP)

( * ) Notice: Subject to any disclaimer, the term of this patent is extended or adjusted under 35 U.S.C. 154(b) by 0 days.

(21) Appl. No.: 15/256,065

(22) Filed: Sep. 2, 2016

(51) Int. Cl.
*B41J 2/175* (2006.01)

(52) U.S. Cl.
CPC ..... *B41J 2/175* (2013.01); *B41J 2/17513* (2013.01)

(58) Field of Classification Search
CPC ..... B41J 2/175; B41J 2/17513; B41J 2/211; B41J 2/1752; B41J 2/17559
See application file for complete search history.

(56) References Cited

U.S. PATENT DOCUMENTS

| | | | |
|---|---|---|---|
| 5,198,156 | A | 3/1993 | Middleton et al. |
| 6,332,676 | B1 | 12/2001 | Santhanam |
| 7,172,272 | B2 | 2/2007 | Tsuchiya et al. |
| 8,608,300 | B2 | 12/2013 | Igawa et al. |
| 2001/0013886 | A1 | 8/2001 | Underwood et al. |
| 2001/0015742 | A1 | 8/2001 | Childers |
| 2001/0024225 | A1 | 9/2001 | Ishizawa et al. |
| 2001/0030675 | A1 | 10/2001 | Kobayashi et al. |
| 2002/0012026 | A1 | 1/2002 | Kubota et al. |
| 2002/0089576 | A1 | 7/2002 | Ishizawa et al. |
| 2002/0109760 | A1 | 8/2002 | Miyazawa et al. |
| 2002/0154570 | A1 | 10/2002 | Gebrian |
| 2002/0167555 | A1 | 11/2002 | Miura et al. |
| 2003/0042274 | A1 | 3/2003 | Johanson |
| 2003/0072216 | A1 | 4/2003 | Araki |
| 2003/0107950 | A1 | 6/2003 | Shepherd et al. |
| 2004/0051766 | A1 | 3/2004 | Miyazawa et al. |
| 2004/0095842 | A1 | 5/2004 | Weetman |
| 2004/0104984 | A1 | 6/2004 | Hall et al. |
| 2005/0046682 | A1 | 3/2005 | Kawamoto |
| 2005/0093211 | A1 | 5/2005 | Shiraishi et al. |
| 2005/0248634 | A1 | 11/2005 | Aruga |
| 2006/0071989 | A1 | 4/2006 | Lewey et al. |
| 2006/0268080 | A1 | 11/2006 | Nakazawa |
| 2006/0290753 | A1 | 12/2006 | Tatsumi et al. |
| 2007/0019047 | A1 | 1/2007 | Kleinert et al. |
| 2007/0052771 | A1 | 3/2007 | Inoue et al. |
| 2007/0052773 | A1 | 3/2007 | Kawamura et al. |

(Continued)

*Primary Examiner* — Thinh H Nguyen
(74) *Attorney, Agent, or Firm* — Aust IP Law

(57) ABSTRACT

A fluidic dispensing device includes a housing having an exterior wall and a fluid reservoir. The exterior wall has a chip mounting surface defining a first plane, and has an opening in fluid communication with the fluid reservoir. An ejection chip is mounted to the chip mounting surface of the housing and is in fluid communication with the opening. The ejection chip has a plurality of ejection nozzles oriented such that a fluid ejection direction is substantially orthogonal to the first plane. A plurality of stir bars are moveably confined within the fluid reservoir. Each of the plurality of stir bars has a respective plurality of paddles, each having a free end tip. The free end tip of the respective plurality of paddles of at least one stir bar intermittently faces toward the opening as the plurality of stir bars rotate.

20 Claims, 9 Drawing Sheets

(56) References Cited

U.S. PATENT DOCUMENTS

| | | | | |
|---|---|---|---|---|
| 2007/0165485 | A1 | 7/2007 | Cai | |
| 2007/0188563 | A1 | 8/2007 | Takahashi | |
| 2007/0242114 | A1 | 10/2007 | Kubota et al. | |
| 2008/0031088 | A1 | 2/2008 | Ukita | |
| 2008/0165233 | A1 | 7/2008 | Lin et al. | |
| 2008/0186368 | A1 | 8/2008 | Silverbrook et al. | |
| 2009/0033725 | A1 | 2/2009 | Toba et al. | |
| 2009/0079802 | A1 | 3/2009 | Ito | |
| 2009/0122121 | A1 | 5/2009 | Kawasaki et al. | |
| 2009/0189931 | A1 | 7/2009 | Noro et al. | |
| 2009/0213159 | A1 | 8/2009 | Aoki et al. | |
| 2009/0251517 | A1 | 10/2009 | Matsumoto | |
| 2009/0289976 | A1 | 11/2009 | Nishimura | |
| 2009/0322840 | A1 | 12/2009 | Wanibe | |
| 2010/0103233 | A1 | 4/2010 | Akatsuka et al. | |
| 2011/0280098 | A1 | 11/2011 | Shiono | |
| 2012/0000645 | A1 | 1/2012 | Willimczik | |
| 2012/0056948 | A1 | 3/2012 | Kim et al. | |
| 2012/0062523 | A1 | 3/2012 | Park et al. | |
| 2012/0075364 | A1 | 3/2012 | Nakazawa | |
| 2012/0105555 | A1 | 5/2012 | Mcfarland et al. | |
| 2012/0140003 | A1 | 6/2012 | Szusdziara et al. | |
| 2012/0200645 | A1 | 8/2012 | Okina | |
| 2012/0200649 | A1 | 8/2012 | Igawa et al. | |
| 2012/0206547 | A1 * | 8/2012 | Shirotori | B41J 2/175 347/86 |
| 2013/0342618 | A1 | 12/2013 | Frasure et al. | |
| 2014/0061961 | A1 | 3/2014 | Ishizawa et al. | |
| 2014/0098146 | A1 | 4/2014 | Kamiyama | |
| 2015/0165399 | A1 | 6/2015 | Rawlings | |

* cited by examiner

FLUIDIC DISPENSING DEVICE HAVING MULTIPLE STIR BARS

CROSS-REFERENCE TO RELATED APPLICATIONS

This application is related to U.S. patent application Ser. Nos. 15/183,666; 15/183,693; 15/183,705; 15/183,722; 15/183,736; 15/193,476; 15/216,104; 15/239,113; 15/278,369; 15/373,123; 15/373,243; 15/373,635; 15/373,684; and Ser. No. 15/435,983.

BACKGROUND OF THE INVENTION

1. Field of the Invention

The present invention relates to fluidic dispensing devices, and, more particularly, to a fluidic dispensing device, such as a microfluidic dispensing device, that carries a fluid for ejection, and having multiple stir bars for mixing the fluid in the fluidic dispensing device.

2. Description of the Related Art

One type of microfluidic dispensing device, such as an ink jet printhead, is designed to include a capillary member, such as foam or felt, to control backpressure. In this type of printhead, the only free fluid is present between a filter and the ejection device. If settling or separation of the fluid occurs, it is almost impossible to re-mix the fluid contained in the capillary member.

Another type of printhead is referred to in the art as a free fluid style printhead, which has a moveable wall that is spring loaded to maintain backpressure at the nozzles of the printhead. One type of spring loaded moveable wall uses a deformable deflection bladder to create the spring and wall in a single piece. An early printhead design by Hewlett-Packard Company used a circular deformable rubber part in the form of a thimble shaped bladder positioned between a lid and a body that contained ink. The deflection of the thimble shaped bladder collapsed on itself. The thimble shaped bladder maintained backpres sure by deforming the bladder material as ink was delivered to the printhead chip.

In a fluid tank where separation of fluids and particulate may occur, it is desirable to provide a mixing of the fluid. For example, particulate in pigmented fluids tend to settle depending on particle size, specific gravity differences, and fluid viscosity. U.S. Patent Application Publication No. 2006/0268080 discloses a system having an ink tank located remotely from the fluid ejection device, wherein the ink tank contains a magnetic rotor, which is rotated by an external rotary plate, to provide bulk mixing in the remote ink tank.

It has been recognized, however, that a microfluidic dispensing device having a compact design, which includes both a fluid reservoir and an on-board fluid ejection chip, presents particular challenges that a simple agitation in a remote tank does not address. For example, it has been determined that not only does fluid in the bulk region of the fluid reservoir need to be remixed, but remixing in the ejection chip region also is desirable, and in some cases, may be necessary, in order to prevent the clogging of the region near the fluid ejection chip with settled particulate.

What is needed in the art is a fluidic dispensing device having multiple stir bars that provide for both bulk fluid remixing and fluid remixing in the vicinity of the fluid ejection chip.

SUMMARY OF THE INVENTION

The present invention provides a fluidic dispensing device having multiple stir bars that facilitate both bulk fluid remixing and fluid remixing in the vicinity of the fluid ejection chip.

The invention, in one form, is directed to a fluidic dispensing device including a housing having an exterior wall and a fluid reservoir. The exterior wall has a chip mounting surface defining a first plane and has an opening. The fluid reservoir is in fluid communication with the opening. An ejection chip is mounted to the chip mounting surface of the housing. The ejection chip is in fluid communication with the opening. The ejection chip has a plurality of ejection nozzles oriented such that a fluid ejection direction is substantially orthogonal to the first plane. A plurality of stir bars is moveably confined within the fluid reservoir. Each of the plurality of stir bars has a respective plurality of paddles, and each of the respective plurality of paddles has a free end tip. The free end tip of the respective plurality of paddles of at least one stir bar of the plurality of stir bars intermittently faces toward the opening that is in fluid communication with the ejection chip as the plurality of stir bars rotate.

The invention, in another form, is directed to a fluidic dispensing device including a housing having a fluid reservoir and an opening. The fluid reservoir is in fluid communication with the opening. A plurality of stir bars is moveably confined within the fluid reservoir. A first stir bar of the plurality of stir bars has a first rotational axis and a first plurality of paddles that rotate around the first rotational axis to define a first rotational area of the first stir bar. A second stir bar of the plurality of stir bars has a second rotational axis and a second plurality of paddles that rotate around the second rotational axis to define a second rotational area of the second stir bar. The first rotational area of the first stir bar overlaps the second rotational area of the second stir bar.

The invention, in another form, is directed to a fluidic dispensing device including a housing having a chamber and an opening. The chamber is coupled in fluid communication with the opening. A first stir bar is located in the chamber. A second stir bar is located in the chamber. A separation wall is in the chamber interposed between the first stir bar and the second stir bar.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
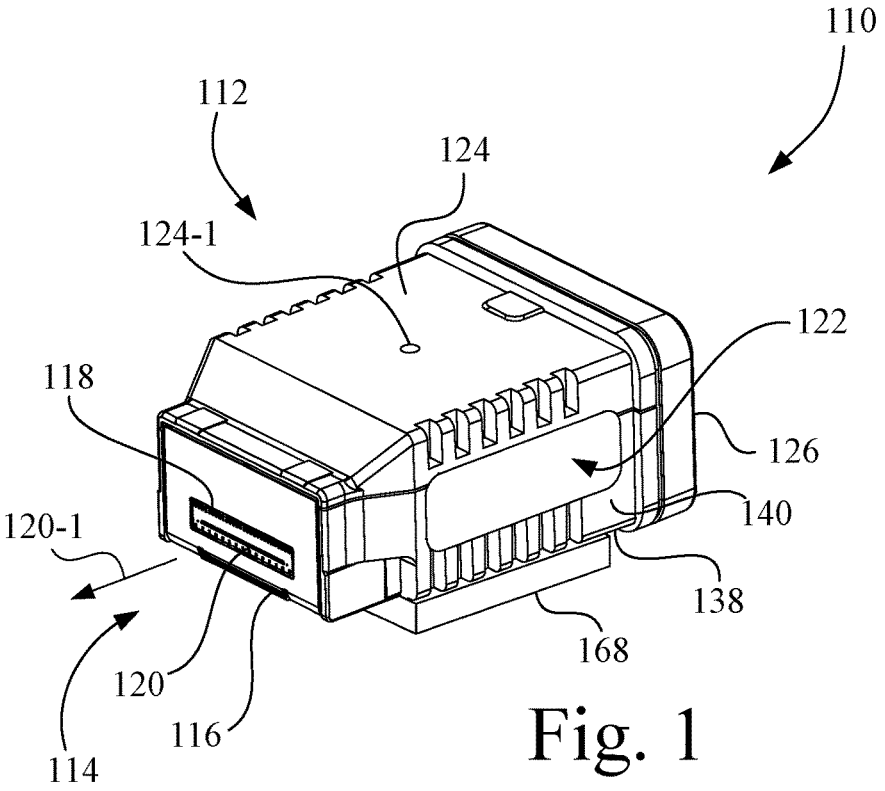
FIG. 1 is a perspective view of an embodiment of a microfluidic dispensing device in accordance with the present invention, in an environment that includes an external magnetic field generator.
Figure 2:
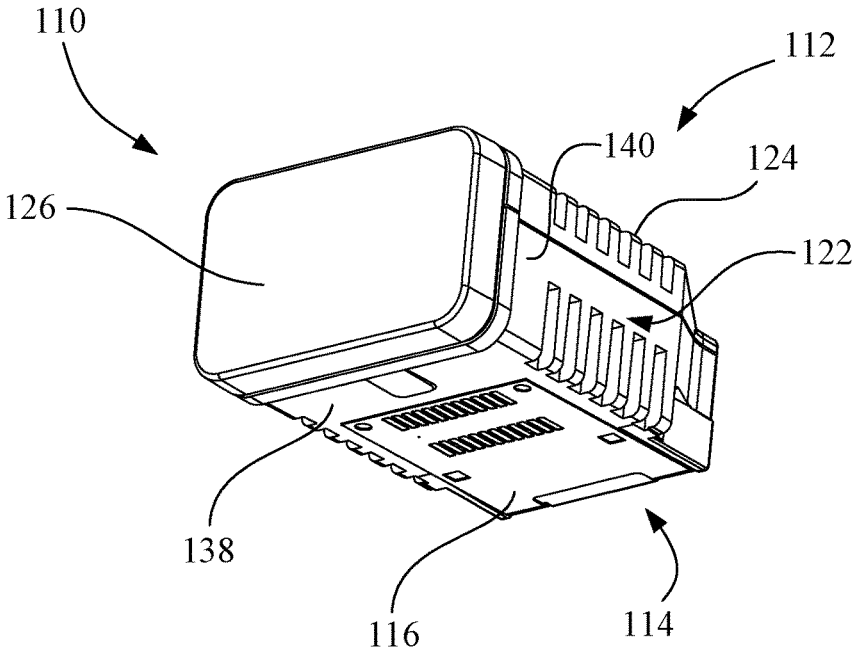
FIG. 2 is another perspective view of the microfluidic dispensing device of FIG. 1.
Figure 3:
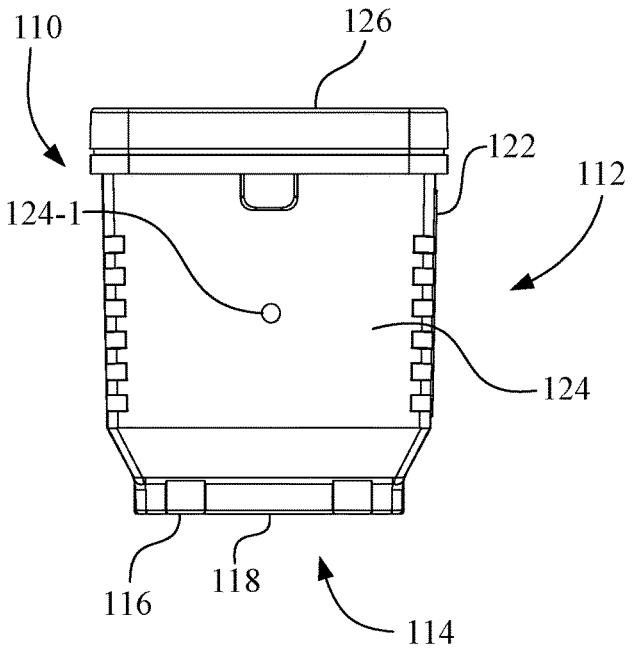
FIG. 3 is a top orthogonal view of the microfluidic dispensing device of FIGS. 1 and 2.
Figure 4:
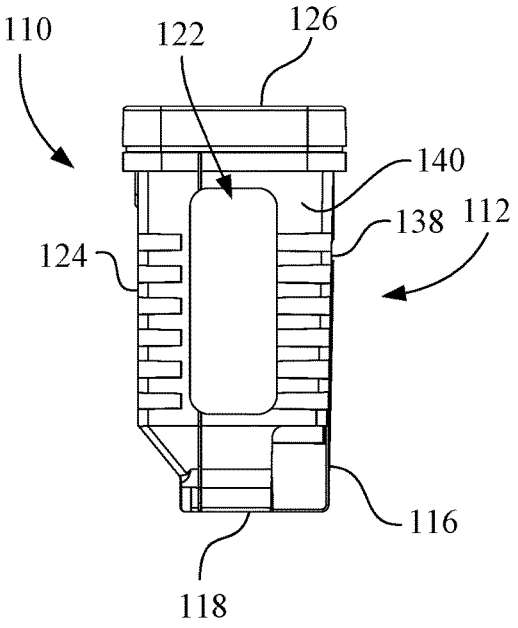
FIG. 4 is a side orthogonal view of the microfluidic dispensing device of FIGS. 1 and 2.
Figure 5:
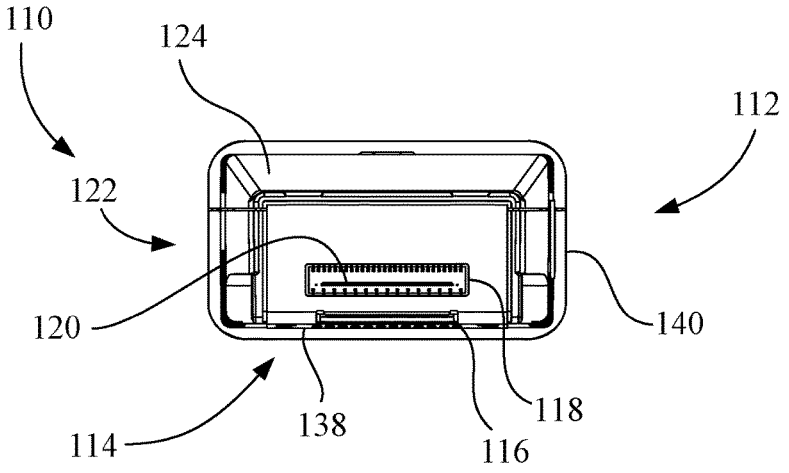
FIG. 5 is an end orthogonal view of the microfluidic dispensing device of FIGS. 1 and 2.

Referring now to the drawings, and more particularly to FIGS. 1-10, there is shown a fluidic dispensing device, which in the present example is a microfluidic dispensing device 110 in accordance with an embodiment of the present invention.

Referring to FIGS. 1-5, microfluidic dispensing device 110 generally includes a housing 112 and a tape automated bonding (TAB) circuit 114. Microfluidic dispensing device 110 is configured to contain a supply of a fluid, such as a fluid containing particulate material, and TAB circuit 114 is configured to facilitate the ejection of the fluid from housing 112. The fluid may be, for example, cosmetics, lubricants, paint, ink, etc.

TAB circuit 114 includes a flex circuit 116 to which an ejection chip 118 is mechanically and electrically connected. Flex circuit 116 provides electrical connection to an electrical driver device (not shown), such as an ink jet printer, configured to operate ejection chip 118 to eject the fluid that is contained within housing 112. In the present embodiment, ejection chip 118 is configured as a plate-like structure having a planar extent formed generally as a nozzle plate layer and a silicon layer, as is well known in the art. The nozzle plate layer of ejection chip 118 has a plurality of ejection nozzles 120 oriented such that a fluid ejection direction 120-1 is substantially orthogonal to the planar extent of ejection chip 118. Associated with each of the ejection nozzles 120, at the silicon layer of ejection chip 118, is an ejection mechanism, such as an electrical heater (thermal) or piezoelectric (electromechanical) device. The operation of such an ejection chip 118 and driver is well known in the micro-fluid ejection arts, such as in ink jet printing.

As used herein, each of the terms substantially orthogonal and substantially perpendicular is defined to mean an angular relationship between two elements of 90 degrees, plus or minus 10 degrees. The term substantially parallel is defined to mean an angular relationship between two elements of zero degrees, plus or minus 10 degrees.

Figure 6:
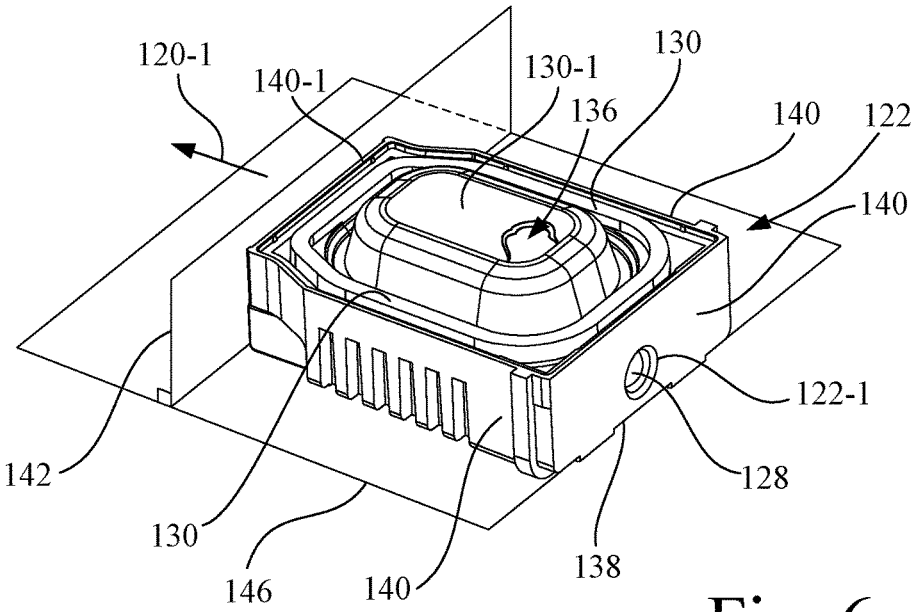
FIG. 6 is a perspective view of the microfluidic dispensing device of FIG. 1, with the end cap and lid removed to expose the body/diaphragm assembly, in relation to first and second planes and to the fluid ejection direction, and with a portion of the diaphragm broken away to illustrate the fluid reservoir.
Figure 7:
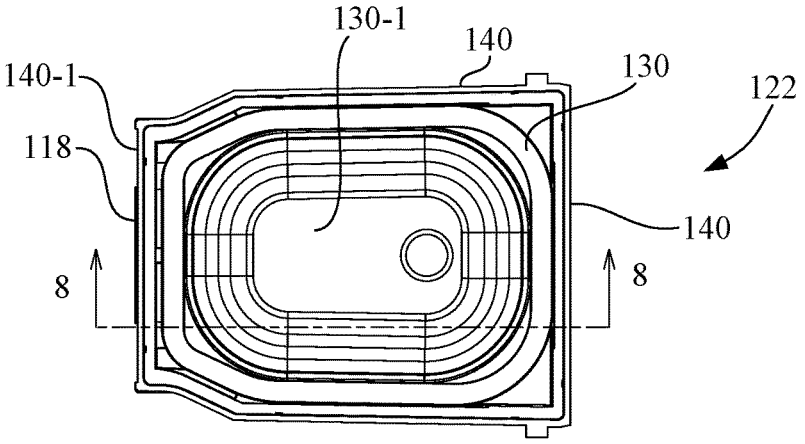
FIG. 7 is a top orthogonal view of the body/diaphragm assembly of FIG. 6.
Figure 8:
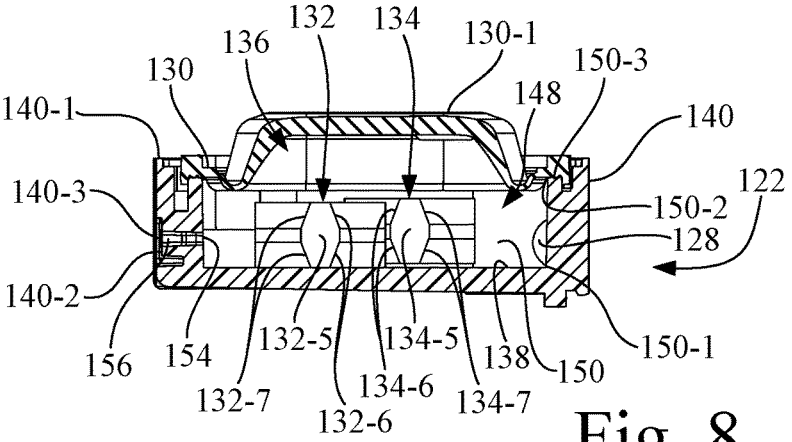
FIG. 8 is a section view of the body/diaphragm assembly of FIG. 6, taken along line 8-8 of FIG. 7, to expose the multiple stir bars located in the fluid reservoir.

Referring to FIGS. 1-5, housing 112 includes a body 122, a lid 124, and an end cap 126. Referring to FIGS. 6 and 8, body 122 includes a fill hole 122-1 and a fill plug 128 (e.g., ball). In the present embodiment, fill plug 128 may be in the form of a stainless steel ball bearing. Referring to FIGS. 6-10 in relation to FIG. 1, contained within housing 112 is a diaphragm 130 and a plurality of stir bars 132, 134. In the present embodiment, there are two stir bars that are individually identified as stir bar 132 and stir bar 134. Each of the housing 112 components and the plurality of stir bars 132, 134 may be made of plastic, using a molding process. Diaphragm 130 is made of rubber, using a molding process.

In general, a fluid (not shown) is loaded through a fill hole 122-1 in body 122 (see FIGS. 6-8) into a sealed region, i.e., a fluid reservoir 136, between body 122 and diaphragm 130. Back pressure in fluid reservoir 136 is set and then maintained by inserting, e.g., pressing, fill plug 128 into fill hole 122-1 to prevent air from leaking into fluid reservoir 136 or fluid from leaking out of fluid reservoir 136. Referring again to FIGS. 1-5, end cap 126 is then placed onto an end of the body 122/lid 124 combination, opposite to ejection chip 118. The plurality of stir bars 132, 134 reside in the sealed fluid reservoir 136 between body 122 and diaphragm 130 that contains the fluid. An internal fluid flow may be generated within fluid reservoir 136 by rotating each of stir bar 132 and stir bar 134, so as to provide fluid mixing and redistribution of particulate in the fluid within the sealed region of fluid reservoir 136. In the present embodiment, as will be discussed in more detail below, the rotational direction of stir bar 134 is opposite to the rotational direction of stir bar 132.

Referring to FIGS. 6-10, body 122 of housing 112 has a base wall 138 and an exterior perimeter wall 140 contiguous with base wall 138. Exterior perimeter wall 140 is oriented to extend from base wall 138 in a direction that is substantially orthogonal to base wall 138. Referring again to FIGS. 1-5, lid 124 is configured to engage exterior perimeter wall 140. Thus, exterior perimeter wall 140 is interposed between base wall 138 and lid 124, with lid 124 being attached to the open free end of exterior perimeter wall 140 by weld, adhesive, or other fastening mechanism, such as a snap fit or threaded union. Attachment of lid 124 to body 122 occurs after the insertion of the plurality of stir bars 132, 134 (see FIG. 8) in body 122 and after the installation of diaphragm 130 (see FIGS. 6-8) on body 122.

Figure 9:
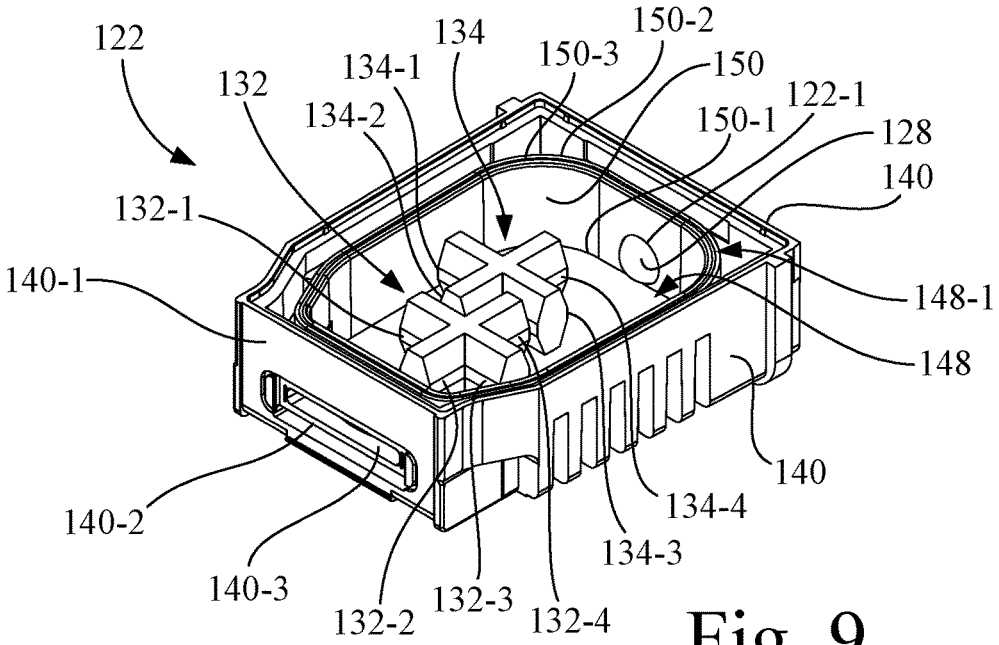
FIG. 9 is a perspective view of the depiction of FIG. 6, with the diaphragm removed to expose the multiple stir bar contained in the body, and with the ejection chip removed to expose the fluid opening in the exterior wall.

Referring to FIGS. 6-10, exterior perimeter wall 140 of body 122 includes an exterior wall 140-1, which is a contiguous portion of exterior perimeter wall 140. As best shown in FIG. 9, exterior wall 140-1 has a chip mounting surface 140-2 that defines a plane 142 (see also FIG. 6), and has a fluid opening 140-3 adjacent to chip mounting surface 140-2 that passes through the thickness of exterior wall 140-1. Ejection chip 118 is mounted, e.g., by an adhesive, to chip mounting surface 140-2 and is in fluid communication with fluid opening 140-3 (see FIG. 8) of exterior wall 140-1. Thus, referring to FIGS. 1, 6 and 7, the planar extent of ejection chip 118 is oriented along plane 142, with the plurality of ejection nozzles 120 oriented such that the fluid ejection direction 120-1 is substantially orthogonal to plane 142. Base wall 138 is oriented along a plane 146 (see FIGS. 6 and 8) that is substantially orthogonal to plane 142 of exterior wall 140-1.

Figure 10:
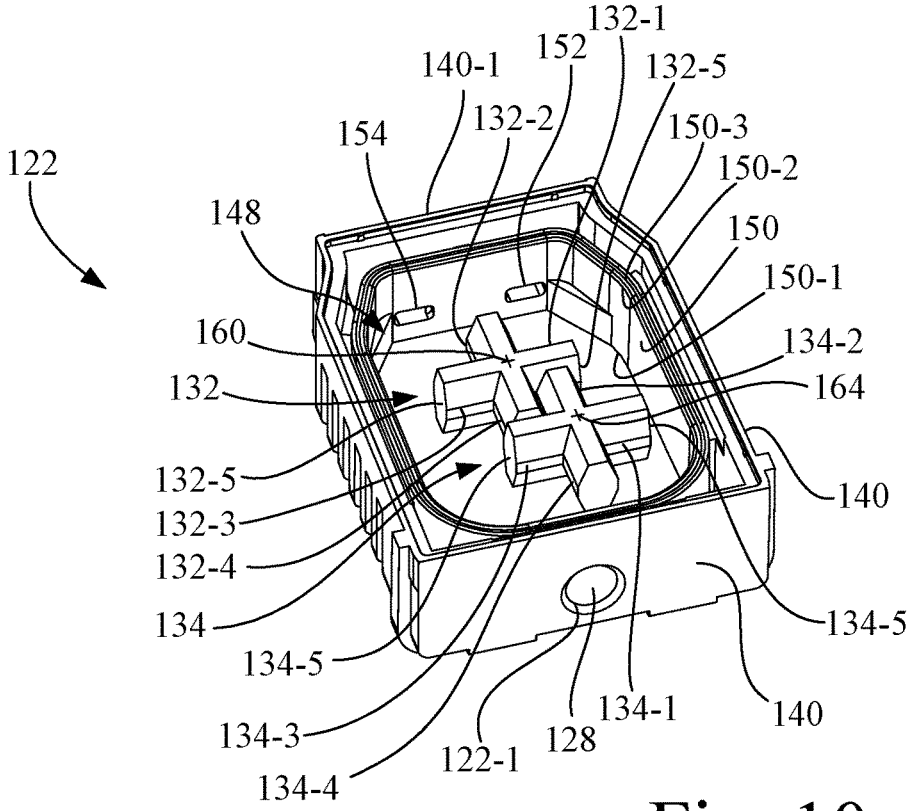
FIG. 10 is another perspective view of the depiction of FIG. 9, in an orientation to show the channel inlet and channel outlet of a fluid channel.

Referring to FIGS. 8-11, body 122 of housing 112 also includes a chamber 148 located within a boundary defined by exterior perimeter wall 140. Chamber 148 forms a portion of fluid reservoir 136, and is configured to define an interior space, and in particular, includes base wall 138 and has an interior perimetrical wall 150 configured to have rounded corners, so as to promote fluid flow in chamber 148. Each of the plurality of stir bars 132, 134 is rotatable, and moveable laterally and longitudinally along base wall 138, within the confining limits defined by interior perimetrical wall 150 of fluid reservoir 136. In the present embodiment, stir bar 132 of the plurality of stir bars 132, 134 is located closer to inlet fluid port 152 and an outlet fluid port 154 than is stir bar 134. Stated differently, as illustrated in FIG. 10, for example, stir bar 132 is interposed between fluid ports 152, 154 and stir bar 134, and in turn, as illustrated in FIG. 9, stir bar 132 is interposed between fluid opening 140-3 and stir bar 134.

Interior perimetrical wall 150 of chamber 148 has an extent bounded by a proximal end 150-1 and a distal end 150-2. Proximal end 150-1 is contiguous with, and may form a transition radius with, base wall 138. Such an edge radius may help in mixing effectiveness by reducing the number of sharp corners. Distal end 150-2 is configured to define a perimetrical end surface 150-3 at an open end 148-1 of chamber 148. Perimetrical end surface 150-3 may include a plurality of perimetrical ribs, or undulations, to provide an effective sealing surface for engagement with diaphragm 130 (see FIGS. 6-11). The extent of interior perimetrical wall 150 of chamber 148 is substantially orthogonal to base wall 138, and is substantially parallel to the corresponding extent of exterior perimeter wall 140 (see FIGS. 9 and 10).

As best shown in FIG. 10, chamber 148 has an inlet fluid port 152 and an outlet fluid port 154, each of which is formed in a portion of interior perimetrical wall 150. The terms "inlet" and "outlet" are terms of convenience that are used in distinguishing between the multiple ports of the present embodiment, and are correlated with a particular rotational direction of the stir bar of the plurality of stir bars 132, 134 that is located closer to inlet fluid port 152 and an outlet fluid port 154, which as illustrated in FIG. 10, for example, is stir bar 132. In other words, it is the rotational direction of the closer stir bar that dictates whether a particular port functions as an inlet port or an outlet port, and it is within the scope of this invention to reverse the rotational direction of the plurality of stir bars 132, 134, and thus reverse the roles of the respective ports within chamber 148.

As shown in FIG. 10, inlet fluid port 152 is separated a distance from outlet fluid port 154 along a portion of interior perimetrical wall 150. Referring also to FIG. 8, body 122 of housing 112 includes a fluid channel 156 interposed between the portion of interior perimetrical wall 150 of chamber 148 and exterior wall 140-1 of exterior perimeter wall 140 that carries ejection chip 118.

Fluid channel 156 is configured to minimize particulate settling in a region of ejection chip 118. Fluid channel 156 is sized, e.g., using empirical data, to provide a desired flow rate while also maintaining an acceptable fluid velocity for fluid mixing through fluid channel 156. In the present embodiment, fluid channel 156 is configured as a U-shaped elongated passage. Fluid channel 156 dimensions, e.g., height and width, and shape are selected to provide a desired combination of fluid flow and fluid velocity for facilitating intra-channel stirring. Fluid channel 156 is configured to connect inlet fluid port 152 of chamber 148 in fluid communication with outlet fluid port 154 of chamber 148, and also connects fluid opening 140-3 (see FIG. 9) of exterior wall 140-1 of exterior perimeter wall 140 in fluid communication with both inlet fluid port 152 and outlet fluid port 154 (see FIG. 10) of chamber 148.

Referring again to FIGS. 1, 6, and 7, diaphragm 130 is positioned between lid 124 and perimetrical end surface 150-3 of interior perimetrical wall 150 of chamber 148. The attachment of lid 124 to body 122 compresses a perimeter of diaphragm 130 thereby creating a continuous seal between diaphragm 130 and body 122. More particularly, diaphragm 130 is configured for sealing engagement with perimetrical end surface 150-3 of interior perimetrical wall 150 of chamber 148 in forming fluid reservoir 136. Thus, in combination, chamber 148 and diaphragm 130 cooperate to define fluid reservoir 136 having a variable volume.

Referring particularly to FIGS. 1 and 6, an exterior surface of diaphragm 130 is vented to the atmosphere through a vent hole 124-1 located in lid 124 so that a controlled negative pressure can be maintained in fluid reservoir 136. Diaphragm 130 is made of rubber, and includes a dome portion 130-1 configured to progressively collapse toward base wall 138 as fluid is depleted from microfluidic dispensing device 110, so as to maintain a desired negative pressure in chamber 148, and thus changing the effective volume of the variable volume of fluid reservoir 136, also referred to herein as a bulk region.

Referring to FIGS. 6-11, stir bar 132 moveably resides in, and is confined within, the variable volume of fluid reservoir 136 and chamber 148, and is located within a boundary defined by the interior perimetrical wall 150 of chamber 148.

Figure 11:
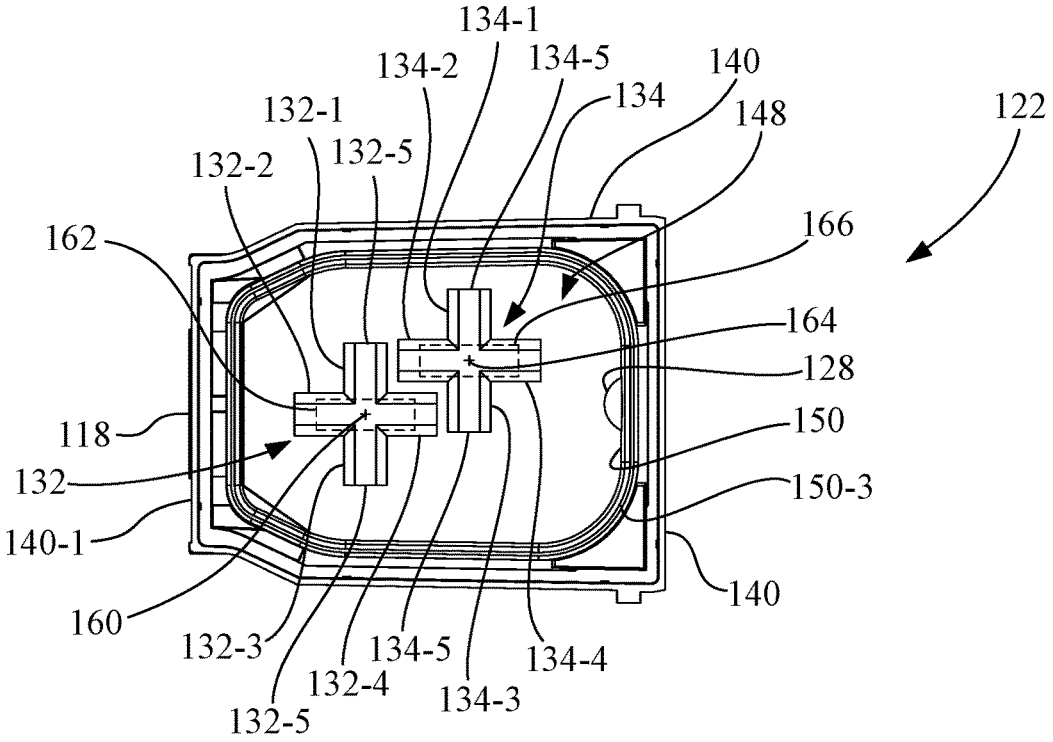
FIG. 11 is a top orthogonal view of the body/stir bar components of FIGS. 9 and 10.
Figure 12:
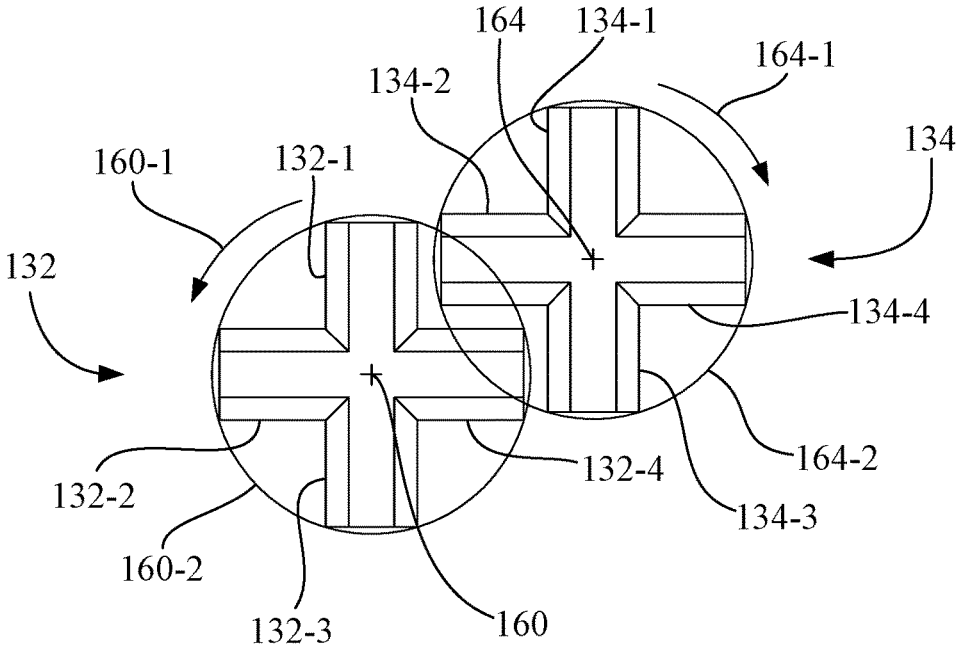
FIG. 12 is a diagrammatic depiction of the two stir bars depicted in FIGS. 7-11, illustrating an overlap of a first rotational area of a first stir bar with a second rotational area of a second stir bar.

Referring also to FIG. 12, stir bar 132 has a rotational axis 160 and a plurality of paddles 132-1, 132-2, 132-3, 132-4 that radially extend away from rotational axis 160 to rotate about rotational axis 160 in a rotational direction 160-1 to define a rotational area 160-2 of stir bar 132. While rotational area 160-2 is depicted as being circular as to a single revolution of stir bar 132 about rotational axis 160, it is to be understood that within a single revolution of stir bar 132 it is possible that the location of rotational axis 160 relative to fluid reservoir 136, base wall 138, and chamber 148 may shift radially, thus resulting in a non-circular, e.g., oval, shape for rotational area 160-2 of stir bar 132. As depicted in FIG. 11, stir bar 132 has a magnet 162, e.g., a permanent bar magnet having opposed poles, i.e., a North pole and a South pole.

Likewise, referring again to FIG. 12, stir bar 134 has a rotational axis 164 and a plurality of paddles 134-1, 134-2, 134-3, 134-4 that radially extend away from rotational axis 164 to rotate about rotational axis 164 in a rotational direction 164-1 to define a rotational area 164-2 of stir bar 134. While rotational area 164-2 is depicted as being circular as to a single revolution of stir bar 134 about rotational axis 164, it is to be understood that within a single revolution of stir bar 134 it is possible that the location of rotational axis 164 relative to fluid reservoir 136, base wall 138, and chamber 148 may shift radially, thus resulting in a non-circular, e.g., oval, shape for rotational area 164-2 of stir bar 134. As depicted in FIG. 11, stir bar 134 has a magnet 166, e.g., a permanent bar magnet having opposed poles, i.e., a North pole and a South pole.

In the present example, with reference to FIGS. 8-12, the plurality of paddles 132-1, 132-2, 132-3, 132-4 of stir bar 132 are in-mesh with the plurality of paddles 134-1, 134-2, 134-3, 134-4 of stir bar 134, and as such, rotational direction 160-1 of stir bar 132 is opposite to the rotational direction 164-1 of stir bar 134. Also, in the present embodiment, an in-mesh timing sequence of the plurality of paddles 132-1, 132-2, 132-3, 132-4 of stir bar 132 with the plurality of paddles 134-1, 134-2, 134-3, 134-4 is such that the like poles of magnet 162 of stir bar 132 and magnet 166 of stir bar 134 repel to aid in opposed rotational directions of stir bar 132 and stir bar 134. As depicted in FIG. 12, the in-mesh relationship of the plurality of paddles 132-1, 132-2, 132-3, 132-4 of stir bar 132 with the plurality of paddles 134-1, 134-2, 134-3, 134-4 of stir bar 134 results in an overlap of the rotational area 160-2 of stir bar 132 with the rotational area 164-2 of stir bar 134.

In operation, each of magnet 162 of stir bar 132 and magnet 166 of stir bar 134 interact with an external magnetic field generator 168 (see FIG. 1) to cause the plurality of stir bars 132, 134 to rotate around their respective rotational axes 160, 164. The principle of operation of the plurality of stir bars 132, 134 is that as magnets 162, 166 are aligned to a strong enough external magnetic field generated by external magnetic field generator 168, then rotating the external magnetic field generated by external magnetic field generator 168 in a controlled manner will rotate the plurality of stir bars 132, 134 in a chaotic, somewhat erratic, manner due to the interaction of the magnetic fields of magnets 162, 166, wherein like poles repel and unlike poles attract, and/or due to impact of stir bars 132, 134 with each other or with interior perimetrical wall 150 of body 122. The external magnetic field generated by external magnetic field generator 168 may be electronically rotated, akin to operation of a stepper motor, or may be rotated via a rotating shaft. Thus, the plurality of stir bars 132, 134 are effective to provide fluid mixing in fluid reservoir 136 by the rotation of stir bar 132 around rotational axis 160 and by the rotation of stir bar 134 around rotational axis 164.

While in the present embodiment, each of stir bar 132 and 134 has a respective magnet, 162, 166, those skilled in the art will recognize that due to the in-mesh relationship of the plurality of paddles 132-1, 132-2, 132-3, 132-4 of stir bar 132 with the plurality of paddles 134-1, 134-2, 134-3, 134-4 of stir bar 134, it is possible to include a magnet in only one of stir bars 132, 134. For example, assume that stir bar 132 includes magnet 162, but stir bar 134 does not. As such, stir bar 132 will interact with the rotating external magnetic field generated by external magnetic field generator 168, but stir bar 134 will not. However, due to the overlap of the rotational area 160-2 of stir bar 132 with the rotational area 164-2 of stir bar 134 that results in the in-mesh relationship, stir bar 134 will be driven to rotate by the rotation of stir bar 132.

Fluid mixing in the bulk region relies on a flow velocity caused by rotation of the plurality of stir bars 132, 134 to create a shear stress at the settled boundary layer of the particulate. When the shear stress is greater than the critical shear stress (empirically determined) to start particle movement, remixing occurs because the settled particles are now distributed in the moving fluid. The shear stress is dependent on both the fluid parameters such as: viscosity, particle size, and density; and mechanical design factors such as: container shape, stir bar geometry, fluid thickness between moving and stationary surfaces, and rotational speed.

A fluid flow is generated by rotating the plurality of stir bars 132, 134 in a fluid region, e.g., fluid reservoir 136, and fluid channel 156 associated with ejection chip 118, so as to ensure that mixed bulk fluid is presented to ejection chip 118 for nozzle ejection and to move fluid adjacent to ejection chip 118 to the bulk region of fluid reservoir 136 to ensure that the channel fluid flowing through fluid channel 156 mixes with the bulk fluid of fluid reservoir 136, so as to produce a more uniform mixture. Although this flow is primarily distribution in nature, some mixing will occur if the flow velocity is sufficient to create a shear stress above the critical value.

The combination of the rotation of stir bar 132 and the counter rotation of stir bar 134 results in a rotational flow of the fluid about a central region associated with each of rotational axis 160 of stir bar 132 and rotational axis 164 of stir bar 134. In the present embodiment, rotational axis 160 of stir bar 132 and rotational axis 164 of stir bar 134 are moveable within the confinement range defined by fluid reservoir 136, and within chamber 148.

Referring to FIGS. 8-12, each paddle of the plurality of paddles 132-1, 132-2, 132-3, 132-4 of stir bar 132 has a respective free end tip 132-5. Referring to FIG. 8, so as to reduce rotational drag, each paddle may include upper and lower symmetrical pairs of chamfered surfaces, forming leading beveled surfaces 132-6 and trailing beveled surfaces 132-7 relative to a rotational direction 160-1 of stir bar 132. It is also contemplated that each of the plurality of paddles 132-1, 132-2, 132-3, 132-4 of stir bar 132 may have a pill or cylindrical shape. In the present embodiment, stir bar 132 has two pairs of diametrically opposed paddles, wherein a first paddle of the diametrically opposed paddles has a first free end tip 132-5 and a second paddle of the diametrically opposed paddles has a second free end tip 132-5.

Likewise, referring to FIGS. 8-12, each paddle of the plurality of paddles 134-1, 134-2, 134-3, 134-4 of stir bar 134 has a respective free end tip 134-5. Referring to FIG. 8, so as to reduce rotational drag, each paddle may include upper and lower symmetrical pairs of chamfered surfaces, forming leading beveled surfaces 134-6 and trailing beveled surfaces 134-7 relative to a rotational direction 164-1 of stir bar 134. It is also contemplated that each of the plurality of paddles 134-1, 134-2, 134-3, 134-4 of stir bar 134 may have a pill or cylindrical shape. In the present embodiment, stir bar 134 has two pairs of diametrically opposed paddles, wherein a first paddle of the diametrically opposed paddles has a first free end tip 134-5 and a second paddle of the diametrically opposed paddles has a second free end tip 134-5.

In the present embodiment, for each of the stir bars 132, 134, the four paddles forming the two pairs of diametrically opposed paddles are equally spaced at 90 degree increments around the respective rotational axis of rotational axes 160, 164. However, the actual number of paddles may be two or more, and preferably three or four, but more preferably four, with each adjacent pair of paddles having the same angular spacing around the respective rotational axis of rotational axes 160, 164. For example, a stir bar configuration having three paddles may have a paddle spacing of 120 degrees, having four paddles may have a paddle spacing of 90 degrees, etc.

Referring to FIGS. 6-10, the plurality of stir bars 132, 134 are located for movement within the variable volume of fluid reservoir 136 (see FIGS. 6 and 8), and more particularly, within the boundary defined by interior perimetrical wall 150 of chamber 148 (see also FIGS. 9-11).

As such, in the present embodiment, the plurality of stir bars 132, 134 are confined within fluid reservoir 136 by the confining surfaces provided by fluid reservoir 136, e.g., by chamber 148 and diaphragm 130. The extent to which the respective stir bars 132, 134 are movable within fluid reservoir 136 is determined by the radial tolerances provided between each of the stir bars 132, 134 and the interior perimetrical wall 150 of chamber 148 in the radial (lateral/longitudinal) direction, and by the axial tolerances between each of the stir bars 132, 134 and the axial limit provided by the combination of base wall 138 of chamber 148 and diaphragm 130.

Thus, referring to FIGS. 7-10, the rotational axes 160, 164 of the plurality of stir bars 132, 134 are free to move radially and axially, e.g., longitudinally, laterally, and/or vertically, within fluid reservoir 136 to the extent permitted by the confining surfaces, e.g., interior surfaces of chamber 148 and diaphragm 130, of fluid reservoir 136. Such confining surfaces also limit the canting of the rotational axes 160, 164 of the plurality of stir bars 132, 134 to be within a predefined angular range, e.g., perpendicular, plus or minus 45 degrees, relative to plane 146 of base wall 138 of chamber 148 and/or to the fluid ejection direction 120-1 (see also FIG. 6). Stated differently, the rotational axes 160, 164 of the plurality of stir bars 132, 134 are moveable radially and axially within fluid reservoir 136, and may be canted in an angular range of perpendicular, plus or minus 45 degrees, relative to plane 146 of base wall 138 of chamber 148 and/or to the fluid ejection direction 120-1.

In the present embodiment, referring to FIGS. 8-11, the plurality of stir bars 132, 134 are moveably confined within fluid reservoir 136, and the confining surfaces of fluid reservoir 136 maintain an orientation of stir bar 132 such that the free end tip 132-5 of a respective paddle of the plurality of paddles 132-1, 132-2, 132-3, 132-4 periodically and intermittently face inlet and outlet fluid ports 152, 154; fluid channel 156; fluid opening 140-3; and ejection chip 118, as stir bar 132 is rotated about rotational axis 160, and permits movement of the plurality of stir bars 132, 134 toward or away from inlet and outlet fluid ports 152, 154; fluid channel 156; fluid opening 140-3; and ejection chip 118.

In accordance with an aspect of the present embodiment, to effect movement of the location of the plurality of stir bars 132, 134 within fluid reservoir 136, first, external magnetic field generator 168 (see FIG. 1) is energized to interact with each of magnet 162 (see FIG. 11) of stir bar 132 and magnet 166 of stir bar 134. If the magnetic field generated by external magnetic field generator 168 is rotating, then the plurality of stir bars 132, 134 will tend to rotate with the magnetic field. Next, housing 112 of microfluidic dispensing device 110 may be moved relative to external magnetic field generator 168, or vice versa.

In other words, magnets 162, 166 of the plurality of stir bars 132, 134 are attracted to the magnetic field generated by external magnetic field generator 168, such that rotational axis 160 and rotational area 160-2 of stir bar 132, and rotational axis 164 and rotational area 164-2 of stir bar 134, will be relocated within fluid reservoir 136 and chamber 148 with a change of location of external magnetic field generator 168 relative to the location of housing 112 of microfluidic dispensing device 110. The attraction of the plurality of stir bars 132, 134 to the magnetic field generated by external magnetic field generator 168 can cause rotational axis 160 of stir bar 132 and rotational axis 164 of stir bar 134 to attempt to occupy the same space, which is not possible, thus resulting in erratic radial movement of stir bar 132 relative to stir bar 134 that causes stir bars 132, 134 to sweep a larger area. Also, such an attempt to occupy the same space may result in an intermittent radial impact of stir bar 132 with stir bar 134, resulting in a vibratory effect that may be beneficial in loosening settled particulate in fluid reservoir 136.

Referring to FIGS. 13-18, there is shown an alternative body 200, which may be substituted for the body 122 depicted in FIGS. 1-11. Body 200 is identical in all respects to body 122 except for the inclusion of a separation wall 202. As such, the description set forth above as to features common to body 122 and to body 200 also will apply to body 200, and thus, for brevity, the full description of such features common to body 122 and to body 200 will not be repeated here although such common features will be identified in FIGS. 13-18. In particular, the difference between body 200 and body 122 is that of the inclusion of separation wall 202 in body 200, which will be described in detail below.

Figure 16:
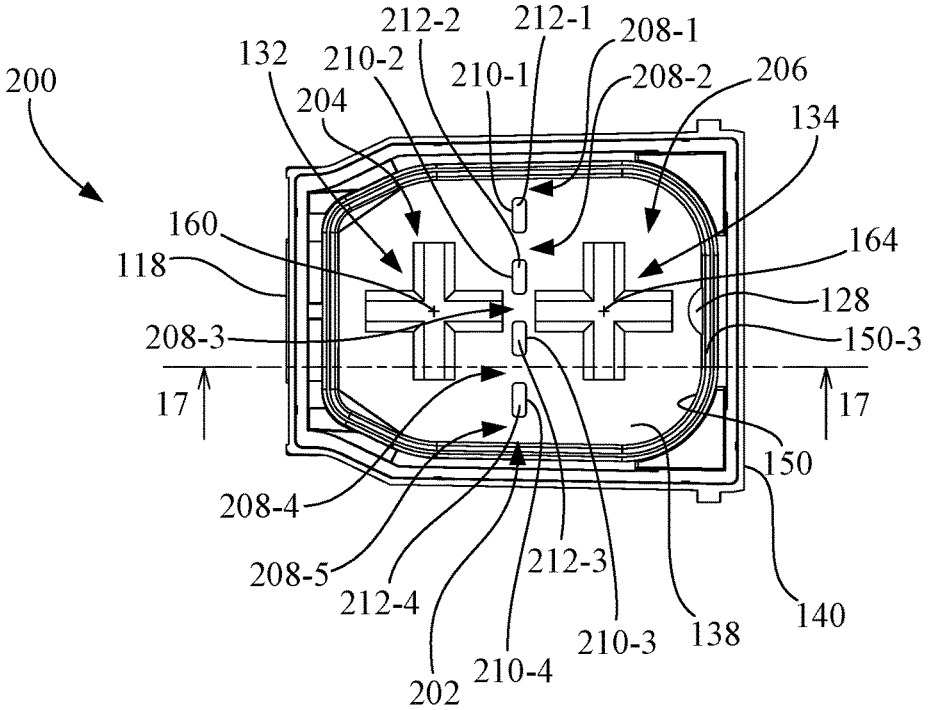
FIG. 16 is a top orthogonal view of the alternative body and stir bar components of FIG. 15.
Figure 17:
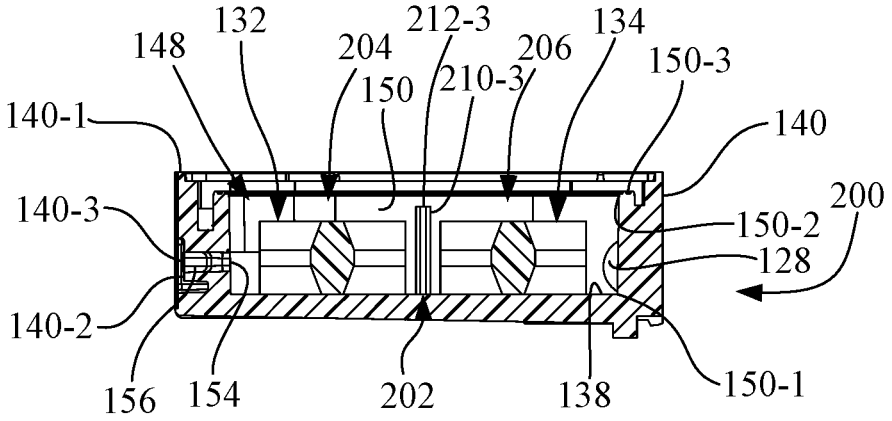
FIG. 17 is a section view of the alternative body of FIGS. 13-16, taken along line 17-17 of FIG. 16.
Figure 18:
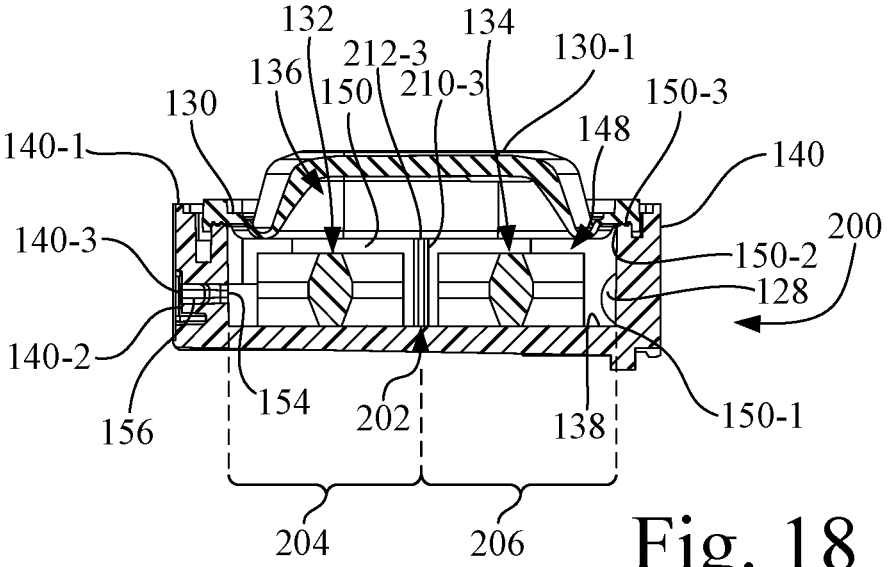
FIG. 18 is the section view of FIG. 17, modified to include a section view of the diaphragm of FIGS. 6-8 installed on the alternative body of FIGS. 13-17.

Referring to FIG. 18, separation wall 202 is positioned in fluid reservoir 136 between base wall 138 and diaphragm 130 to divide fluid reservoir 136, and in turn chamber 148, into a first region 204 and a second region 206 (see also FIG. 17). Referring also to FIGS. 13-16, separation wall 202 has at least one transverse opening 208, and in the present embodiment, includes a plurality of transverse openings 208, which are individually identified as transverse opening 208-1, transverse opening 208-2, transverse opening 208-3, transverse opening 208-4 and transverse opening 208-5. Each of the plurality of transverse openings 208 connects the first region 204 in fluid communication with the second region 206. Referring also to FIG. 17, separation wall 202 is interposed between the stir bar 132 and the stir bar 134 of the plurality of stir bars 132, 134, such that stir bar 132 is located in its entirety in the first region 204 and stir bar 134 is located in its entirety in the second region 206.

Figure 13:
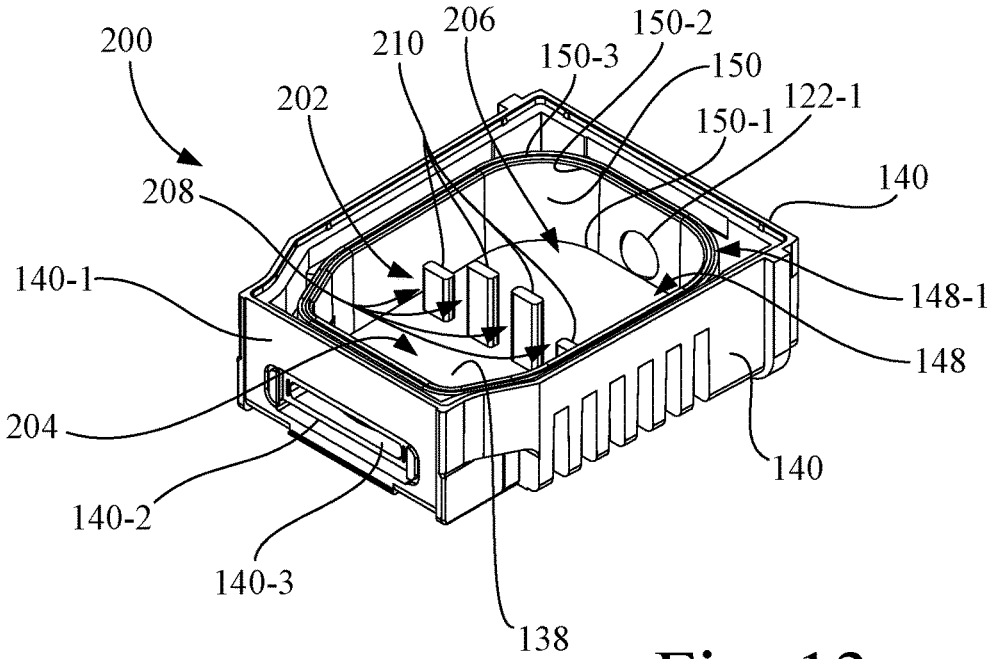
FIG. 13 is a perspective view of an alternative body having a separation wall, which may be substituted for the body depicted in FIGS. 1-11.
Figure 14:
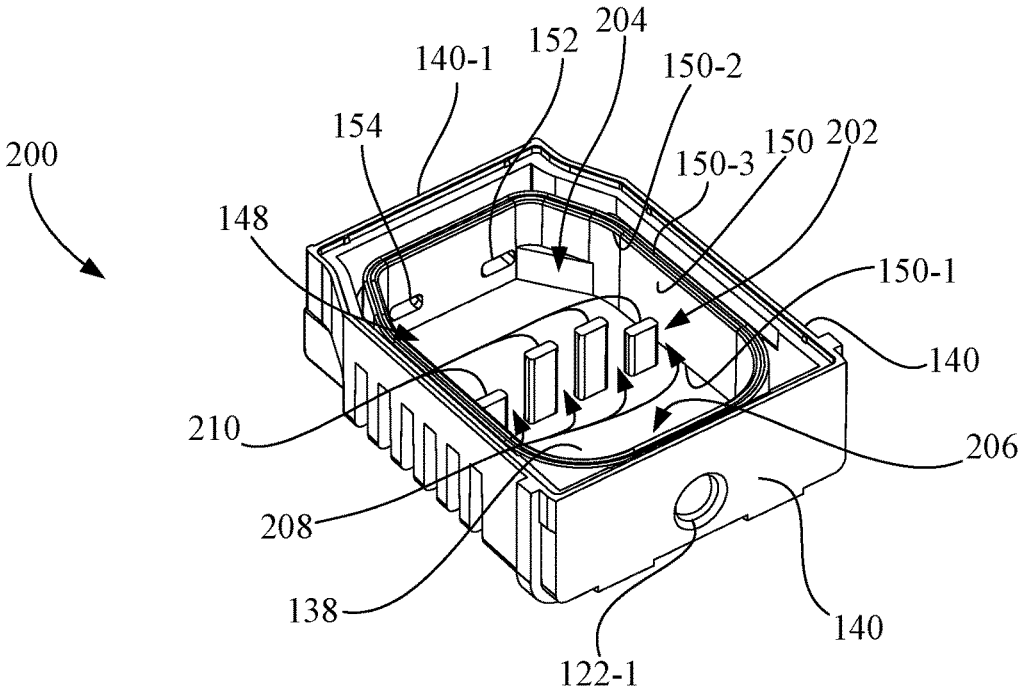
FIG. 14 is another perspective view of the depiction of FIG. 13, in an orientation to show the channel inlet and channel outlet of a fluid channel in relation to the separation wall.
Figure 15:
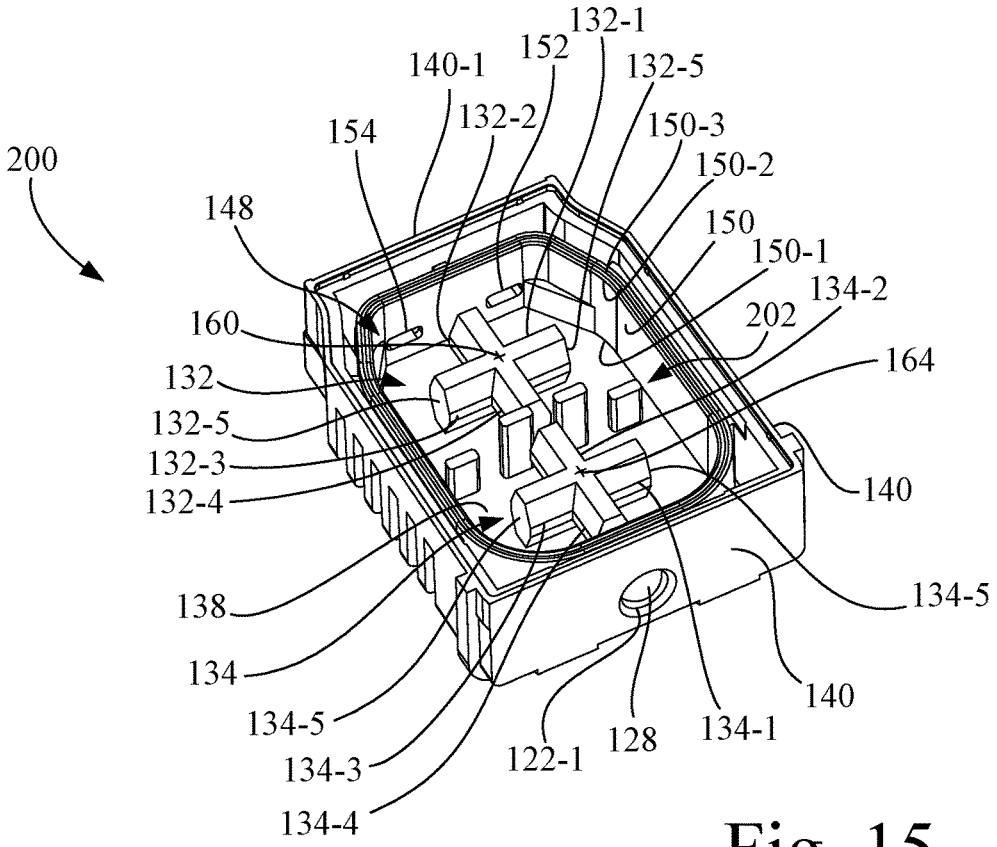
FIG. 15 is a perspective view corresponding to the depiction of the alternative body of FIGS. 13 and 14, with the two stir bars inserted on opposite sides of the separation wall.

As best shown in FIGS. 13-15, with reference to FIG. 18, separation wall 202 has a profile shape selected to facilitate a collapse of diaphragm 130 toward base wall 138 as fluid is depleted from fluid reservoir 136 and chamber 148. In addition, the shape, e.g., height, of separation wall 202 is selected to prevent contact of diaphragm 130 with either of the plurality of stir bars 132, 134. In the present embodiment, separation wall 202 may include two or more spaced posts 210. In the present example, referring also to FIG. 16, there are four posts that are individually identified as post 210-1, post 210-2, post 210-3, and post 210-4. Each of the posts 210 extend from base wall 138 in a direction substantially perpendicular to base wall 138 to a respective free end tip 212-1, free end tip 212-2, free end tip 212-3, and free end tip 212-4. In other words, in the present embodiment, each of the posts 210 of separation wall 202 extends in a cantilever manner from base wall 138.

Thus, referring to FIGS. 17 and 18, at least a portion of separation wall 202 is taller than a height of each of the stir bars 132, 134. In the present embodiment, referring to FIGS. 13-16, in the present embodiment, the outer posts 210-1, 210-4 of posts 210 are the same length as measured from base wall 138, the central posts 210-2, 210-3 of posts 210 are the same length as measured from base wall 138, and the central posts 210-2, 210-3 are longer than the outer posts 210-1, 210-4. In the present embodiment, an extent of each of the central posts 210-2, 210-3 of posts 210 from base wall 138 to its respective free end tip is longer than a height of each of the stir bars 132, 134 (see FIGS. 15, 17 and 18).

As identified in FIGS. 13, 14, and 16, a respective transverse opening of the plurality of transverse openings 208 is present between any two adjacent posts of the plurality of spaced posts 210 to facilitate fluid communication between the first region 204 and the second region 206. Referring to FIG. 16, for example, in the present embodiment the transverse opening 208-1 is located between interior perimetrical wall 150 and post 210-1; transverse opening 208-2 is located between post 210-1 and post 210-2; transverse opening 208-3 is located between post 210-2 and post 210-3; transverse opening 208-4 is located between post 210-3 and post 210-4; and transverse opening 208-5 is located between post 210-4 and interior perimetrical wall 150.

Figure 19:
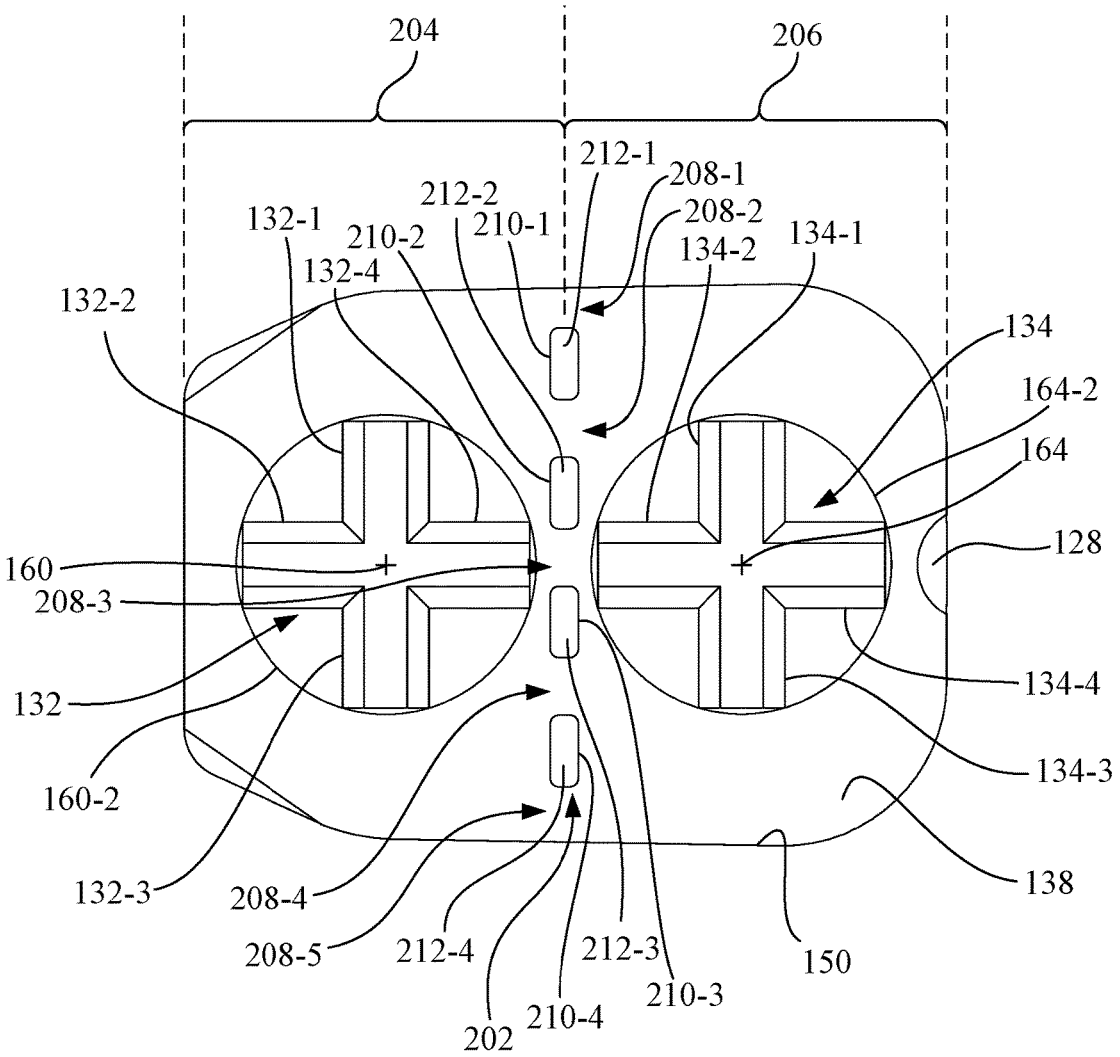
FIG. 19 is an enlarged portion of the depiction of FIG. 16, illustrating the separation wall separating a first rotational area of a first stir bar from a second rotational area of a second stir bar.

As depicted in FIG. 19, rotational area 160-2 of stir bar 132 is located in its entirety in first region 204. Likewise, rotational area 164-2 of stir bar 134 is located in its entirety in second region 206. Thus, in contrast to the non-separated embodiment depicted in FIGS. 11-12, body 200 having separation wall 202 separates the first rotational area 160-2 of stir bar 132 from the second rotational area 164-2 of the stir bar 134. The separation wall 202 prevents first rotational area 160-2 of stir bar 132 from overlapping, i.e., intersecting, the second rotational area 164-2 of stir bar 134. In turn, the plurality of paddles 132-1, 132-2, 132-3, 132-4 of stir bar 132 are prevented from being in-mesh with the plurality of paddles 134-1, 134-2, 134-3, 134-4 of stir bar 134. As such, in the embodiment of FIGS. 13-19, the respective rotational direction of each of stir bar 132 and stir bar 134 may be in opposite rotational directions, may be in the same rotational direction, or may periodically change between the same rotational direction and opposite rotational directions.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fluidic dispensing device, comprising:

a housing having an exterior wall and a fluid reservoir, the exterior wall having a chip mounting surface defining a first plane and having an opening, the fluid reservoir being in fluid communication with the opening;

an ejection chip mounted to the chip mounting surface of the housing, the ejection chip being in fluid communication with the opening, the ejection chip having a plurality of ejection nozzles oriented such that a fluid ejection direction is substantially orthogonal to the first plane; and a plurality of stir bars moveably confined within the fluid reservoir, each of the plurality of stir bars having a respective plurality of paddles, and each of the respective plurality of paddles having a free end tip, wherein the free end tip of the respective plurality of paddles of at least one stir bar of the plurality of stir bars intermittently faces toward the opening that is in fluid communication with the ejection chip as the plurality of stir bars rotate.

2. The fluidic dispensing device of claim 1, wherein the plurality of stir bars includes a first stir bar and a second stir bar, wherein the first stir bar is located closer to the opening than the second stir bar such that the first stir bar is interposed between the opening and the second stir bar.

3. The fluidic dispensing device of claim 1, wherein the plurality of stir bars includes a first stir bar and a second stir bar, the first stir bar having a first rotational axis and a first plurality of paddles that rotate around the first rotational axis to define a first rotational area of the first stir bar, the second stir bar of the plurality of stir bars having a second rotational axis and a second plurality of paddles that rotate around the second rotational axis to define a second rotational area of the second stir bar, wherein the first rotational area of the first stir bar overlaps the second rotational area of the second stir bar.

4. The fluidic dispensing device of claim 1, wherein the plurality of stir bars includes a first stir bar and a second stir bar, the first stir bar having a first rotational axis and a first plurality of paddles that rotate around the first rotational axis to define a first rotational area of the first stir bar, and the second stir bar of the plurality of stir bars having a second rotational axis and a second plurality of paddles that rotate around the second rotational axis to define a second rotational area of the second stir bar, and further comprising:

a separation wall positioned in the fluid reservoir to separate the first rotational area of the first stir bar from the second rotational area of the second stir bar.

5. The fluidic dispensing device of claim 1, further comprising a separation wall positioned in the fluid reservoir to divide the fluid reservoir into a first region and a second region, the separation wall having at least one transverse opening to connect the first region in fluid communication with the second region, and wherein a first stir bar of the plurality of stir bars is located in its entirety in the first region and a second stir bar of the plurality of stir bars is located in its entirety in the second region.

6. The fluidic dispensing device of claim 1, wherein the fluid reservoir has a chamber having an interior perimetrical wall and a base wall, the interior perimetrical wall of the chamber having an extent bounded by a proximal end and a distal end, the proximal end being contiguous with a base wall and the distal end defines a perimetrical end surface, and fluid reservoir further including:

a diaphragm engaged in sealing engagement with the perimetrical end surface, the chamber and the diaphragm cooperating to define a variable volume;

a separation wall positioned in the fluid reservoir between the base wall and the diaphragm to divide the fluid reservoir into a first region and a second region, the separation wall having a plurality of transverse openings to connect the first region in fluid communication with the second region, and wherein a first stir bar of the plurality of stir bars is located in its entirety in the first region and a second stir bar of the plurality of stir bars is located in its entirety in the second region.

7. A fluidic dispensing device, comprising:

a housing having a fluid reservoir and an opening, the fluid reservoir being in fluid communication with the opening; and a plurality of stir bars moveably located within the fluid reservoir, a first stir bar of the plurality of stir bars having a first rotational axis and a first plurality of paddles that rotate around the first rotational axis to define a first rotational area of the first stir bar, and a second stir bar of the plurality of stir bars having a second rotational axis and a second plurality of paddles that rotate around the second rotational axis to define a second rotational area of the second stir bar, wherein the first rotational area of the first stir bar overlaps the second rotational area of the second stir bar.

8. The fluidic dispensing device of claim 7, wherein the first plurality of paddles of the first stir bar are drivably engaged with the second set of paddles of the second stir bar, such that the first rotational direction of the first stir bar is opposite to the second rotational direction of the second stir bar.

9. The fluidic dispensing device of claim 7, wherein the first stir bar has a magnet for driving engagement with an external magnetic field generator, and wherein a rotational driving force is supplied by the first plurality of paddles of the first stir bar to the second plurality of paddles of the second stir bar by a rotation of the first stir bar.

10. The fluidic dispensing device of claim 7, wherein the first rotational axis and the second rotational axis are substantially parallel.

11. The fluidic dispensing device of claim 7, wherein at least one of the first stir bar and the second stir bar has a magnet.

12. The fluidic dispensing device of claim 7, comprising:

a first bar magnet located in the first stir bar and oriented to intersect the first rotational axis, and wherein opposed poles of the first bar magnet are located in diametrically opposed paddles of the first plurality of paddles; and a second bar magnet located in the second stir bar and oriented to intersect the second rotational axis, and wherein opposed poles of the second bar magnet are respectively located in diametrically opposed paddles of the second plurality of paddles.

13. The fluidic dispensing device of claim 7, wherein the fluid reservoir has a chamber having an interior perimetrical wall having at least one port in fluid communication with the opening, each of the plurality of stir bars being laterally and longitudinally located within the fluid reservoir within a boundary defined by the interior perimetrical wall.

14. The fluidic dispensing device of claim 7, wherein the fluid reservoir has a chamber having an interior perimetrical wall and a base wall, the interior perimetrical wall of the chamber having an extent bounded by a proximal end and a distal end, the proximal end being contiguous with a base wall and the distal end defines a perimetrical end surface at a lateral opening of the chamber, and fluid reservoir further including:

a diaphragm engaged in sealing engagement with the perimetrical end surface, the chamber and the diaphragm cooperating to define a variable volume, the chamber and the diaphragm defining confining surfaces of the fluid reservoir, and each of the plurality of stir bars being confined for movement within the variable volume by the confining surfaces of the fluid reservoir.

15. A fluidic dispensing device, comprising:

a housing having a chamber and an opening, the chamber coupled in fluid communication with the opening;

a first stir bar located in the chamber;

a second stir bar located in the chamber; and a separation wall positioned in the chamber, the separation wall being interposed between the first stir bar and the second stir bar.

16. The fluidic dispensing device of claim 15, wherein the separation wall divides the chamber into a first region and a second region, the separation wall having at least one transverse opening to connect the first region in fluid communication with the second region, the first stir bar being located in the first region and the second stir bar being located in the second region.

17. The fluidic dispensing device of claim 15, wherein the separation wall divides the chamber into a first region and a second region, the separation wall defining a plurality of transverse openings to connect the first region in fluid communication with the second region, the first stir bar being located in the first region and the second stir bar being located in the second region.

18. The fluidic dispensing device of claim 15, wherein the chamber has a base wall, and the separation wall divides the chamber into a first region and a second region, the separation wall having a plurality of spaced posts that extend from the base wall in a direction substantially perpendicular to the base wall, and wherein a respective transverse opening is present between any two adjacent posts of the plurality of spaced posts to facilitate fluid communication between the first region and the second region, the first stir bar being located in the first region and the second stir bar being located in the second region.

19. The fluidic dispensing device of claim 15, the separation wall being located in the chamber to divide the chamber into a first region and a second region, the separation wall having at least one transverse opening to connect the first region in fluid communication with the second region, the first stir bar having a first rotational axis and a first plurality of paddles that rotate around the first rotational axis to define a first rotational area of the first stir bar, the first rotational area being located in the first region, and the second stir bar of the plurality of stir bars having a second rotational axis and a second plurality of paddles that rotate around the second rotational axis to define a second rotational area of the second stir bar, the second rotational area being located in the second region.

20. The fluidic dispensing device of claim 15, the chamber having an interior perimetrical wall and a base wall, the interior perimetrical wall of the chamber having an extent bounded by a proximal end and a distal end, the proximal end being contiguous with a base wall and the distal end defines a perimetrical end surface; and further comprising a diaphragm engaged in sealing engagement with the perimetrical end surface, the separation wall being positioned between the base wall and the diaphragm, the separation wall having a shape selected to facilitate a collapse of the diaphragm toward the base wall as fluid is depleted from the chamber.

* * * * *